United States Patent [19]

Dibb

[11] Patent Number: 4,649,589

[45] Date of Patent: Mar. 17, 1987

[54] POOL CLEANER

[76] Inventor: Terence L. Dibb, 4 Teague Place, Bullcreek, Western Australia, Australia

[21] Appl. No.: 713,388

[22] PCT Filed: Jun. 26, 1984

[86] PCT No.: PCT/AU84/00115

§ 371 Date: Feb. 11, 1985

§ 102(e) Date: Feb. 11, 1985

[87] PCT Pub. No.: WO85/00189

PCT Pub. Date: Jan. 17, 1985

[30] Foreign Application Priority Data

Jun. 29, 1983 [AU] Australia ..... PG0040

[51] Int. Cl.[4] ..... E04H 3/20

[52] U.S. Cl. ..... 15/1.7

[58] Field of Search ..... 15/1.7, 415 R, 415 A, 15/421, 422; 210/169; 134/42

[56] References Cited

U.S. PATENT DOCUMENTS 2,769,549 11/1956 Bixby ..... 15/1.7
2,902,705 9/1959 Eistrup ..... 15/1.7
4,053,412 10/1977 Stix ..... 15/1.7

FOREIGN PATENT DOCUMENTS 578354 6/1946 United Kingdom ..... 15/1.7

*Primary Examiner*—Edward L. Roberts
*Attorney, Agent, or Firm*—Harness, Dickey & Pierce

[57] ABSTRACT

A pool cleaner for swimming pools comprising a body (10) which includes a first inlet end (12), a second outlet end (14) and an intake portion (16). The intake portion (16) has a roof (22), a pair of side walls (24) which depend from the roof and an open front which provides the first inlet end (12), but no floor. A removable water-pervious collection receptacle (28) is mounted on the body (10) about the second outlet end (14) thereof. A coupling means (30) is mounted on the body (10) for coupling a handle (32) to the body (10).

11 Claims, 5 Drawing Figures

POOL CLEANER

This invention relates to a pool cleaner.

Over a period of time a substantial amount of debris such as leaves from nearby trees, accumulates in swimming pools. The debris is not only unsightly but is also detrimental to pool cleanliness and should therefore be removed regularly. Some debris floats to the surface of the pool and can be fairly readily collected therefrom by known methods. However, other debris sinks to the floor of the pool and cannot be readily recovered, except by using complex and expensive suction devices connectable to the pool filtration system.

It is an object of this invention to provide a simple but effective means for removing debris from floors of pools, which may also be used for removing debris from surfaces of pools.

In one form the invention resides in a pool cleaner comprising: a hollow body having a first inlet end, a second outlet and an intake portion; the intake portion including a roof, a pair of side walls depending from the roof, an open front providing said first inlet end, and an open bottom; coupling means for coupling a handle to the body; and a water-previous collection receptacle mountable on the body about the outlet end thereof.

Preferably, the intake portion of the body tapers inwardly from the inlet end.

Preferably, the body includes an outlet portion extending upwardly and rearwardly of the intake portion adjacent the rear end thereof and terminating in said outlet end, said outlet portion providing a wall at the rear end of the intake portion. The outlet portion preferably opens into the intake portion at the rear end thereof and at a portion of the roof thereof adjacent the rear end.

The coupling means preferably incorporates a pivotal joint to permit relative movement between the handle and the body. It is preferred that the pivotal joint be in the form of a universal joint, so as to permit relative pivotal movement in all directions between the handle and the body.

Preferably a locking means is provided for selectively locking the handle and the body against said relative movement.

The invention will be better understood by reference to the following description of several specific embodiments thereof, as shown in the accompanying drawings in which.

Figure 1:
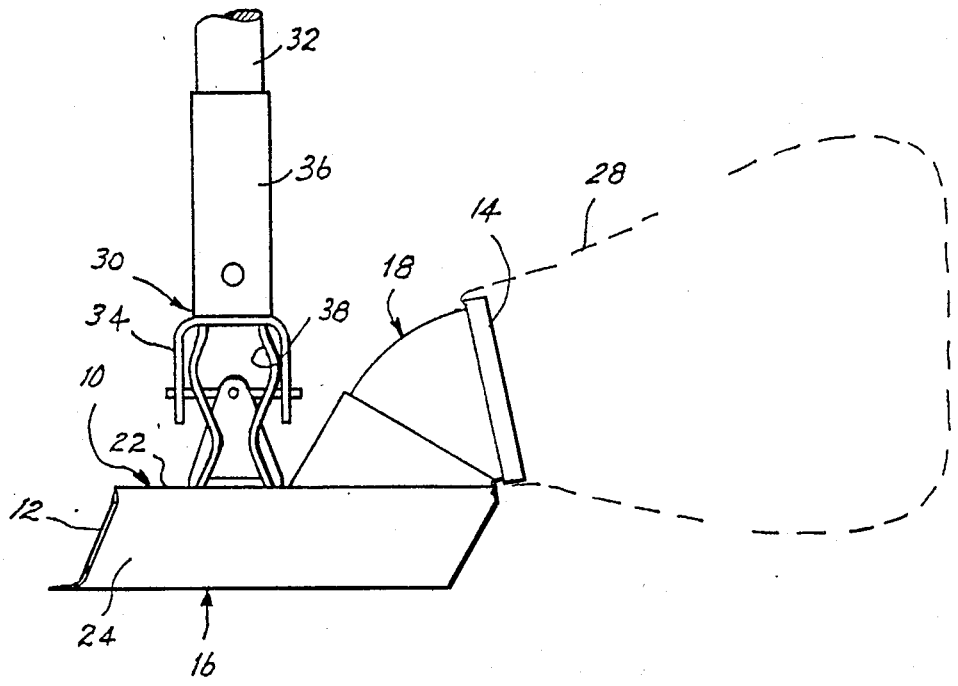
FIG. 1 is a side elevational view of a pool cleaner according to the first embodiment.
Figure 2:
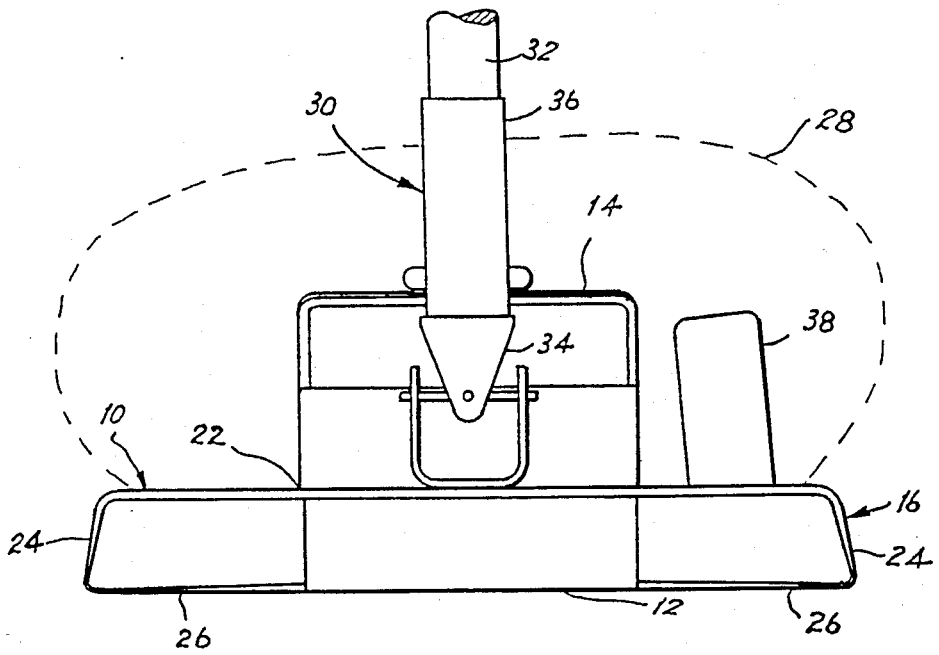
FIG. 2 is a front elevational view of the pool cleaner of FIG. 1.

Referring to FIGS. 1 to 4 of the drawings, the pool cleaner according to the first embodiment comprises a hollow body 10 having a first inlet end 12, a second outlet end 14, an intake portion 16 and an outlet portion 18.

A passage 20, which exists because of the hollow nature of the body, extends through the body between the inlet end 12 and outlet end 14.

The intake portion 16 has a roof 22, a pair of side walls 24 depending from the roof, an open front providing said first inlet end 12, and an open bottom (i.e. no floor). At the lowermost edge of each side wall 24 there is an inturned flange providing a runner 26 which facilitates sliding movement of the body along the floor of a swimming pool, in a manner to be described hereinafter.

Figure 3:
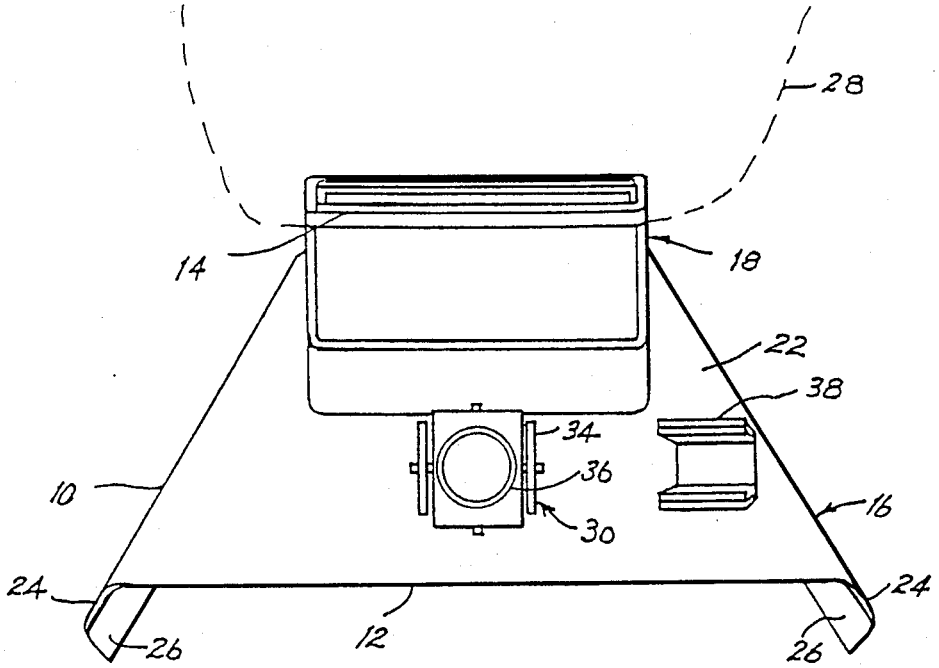
FIG. 3 is a plan view of the pool cleaner of FIG. 1.

The intake portion 16 of the body tapers inwardly from the inlet end 12, as can be best seen in FIG. 3 of the drawings. It is described that the inlet end 12 of the intake portion of the body has a flow area which is not too great in relation to the flow area of the smallest section of the outlet portion 18; for preference, the two flow areas are approximately equal. If the flow area of the smallest section of the outlet portion is too small in relation to that of the inlet end, then water may be prevented, in use, from entering the intake portion. This in turn may impede normal flow of debris through the body (as will be described hereinafter).

Figure 4:
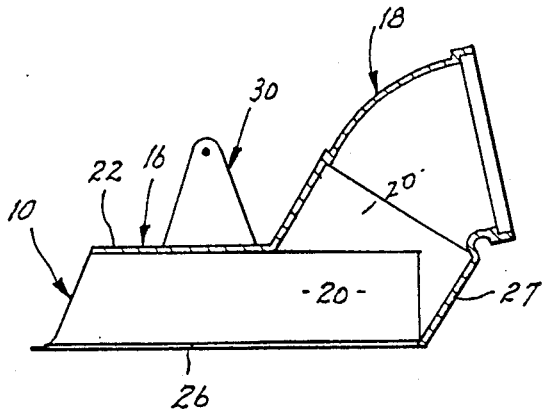
FIG. 4 is a central longitudinal sectional elevation of the pool cleaner of FIG. 1, with the collection receptacle omitted.

The outlet portion 18 extends rearwardly and upwardly of the intake portion 16 at the rear end thereof and terminates at said outlet end 14. In this way the outlet portion in effect provides a wall 27 at the rear end of the intake portion 16, as best seen in FIG. 4 of the drawings. The outlet portion opens into the intake portion at the rear end thereof and at the portion of the roof 22 adjacent said rear end, again as best seen in FIG. 4.

A collection receptacle 28 is removably mounted on the outlet portion 18 of the body about the outlet end 14. The collection receptacle 28 is water-pervious, but capable of retaining debris such as leaves and other solid matter which is not too finely divided. In the illustrated arrangement the collection receptacle is in the form of a flexible mesh bag.

Mounted on the body 10 is a coupling means 30 for coupling an elongated handle 32 to the body. The coupling means 30 includes a universal joint 34 one end of which is secured to the roof 22 of the intake portion of the body and the other end of which is secured to a sleeve 36 which is adapted to securely receive one end of the handle 32. The universal joint 34 permits relative movement between the body and the handle in all directions.

A locking means 38 is provided for selectively locking the handle against movement relative to the body. In the illustrated arrangement the locking means 38 is in the form of a clip mounted on the body. The clip is adapted to grip and hold the sleeve 36 when the latter is urged into engagement with the clip, so as to retain the sleeve (and hence the handle) against pivotal movement relative to the body. The locking means 38 may be of any suitable form other than the clip, if desired. In addition, in an alternative arrangement the locking means may be adapted to lock the handle in a selected one of a multiplicity of positions relative to the body.

The operation of the pool cleaner according to the first embodiment will now be described. The pool cleaner is lowered to the floor of the pool and with the runners 26 resting thereon, the cleaner is swept across the floor of the pool by means of the handle 32. As the pool cleaner travels across the floor, water flows relative to the body through the passage 20 and into the water-pervious collection receptacle 28. Any debris over which the intake portion of the body passes is carried along the passage 20 in the body and into the collection receptacle. The debris is retained in the collection receptacle, while the water passes therethrough. The inturned flanges which provide the runners 26 at the lowermost edges of the side walls 24, assist in guiding the flow of water and debris along the section of the passage 20 within the intake portion 16.

As the pool cleaner is advanced along the floor of the pool, the drag force imposed by the water on the part of the pool cleaner rearward of the universal joint 34 (and in particular the collection receptacle), acts to cause the pool cleaner to assume an orientation in which the inlet end 12 faces the forward direction.

After completion of the cleaning operation or when the collection receptacle requires emptying, the collection receptacle can be detached from the body to permit removal of collected debris therein, and then replaced for further use.

In circumstances where the collection receptacle is in the form of a flexible bag, it will assume a collapsed position in which it lies across the outlet end 14 of the body, when it is lifted from within the pool. In this way the collapsed bag closes the outlet end so as to prevent the escape of debris collected therein.

The handle 32 may be locked against pivotal movement relative to the body by way of the locking means 38. This converts the pool cleaner from a pool floor sweeper to a surface cleaner capable of removing debris from the surface of a pool.

Figure 5:
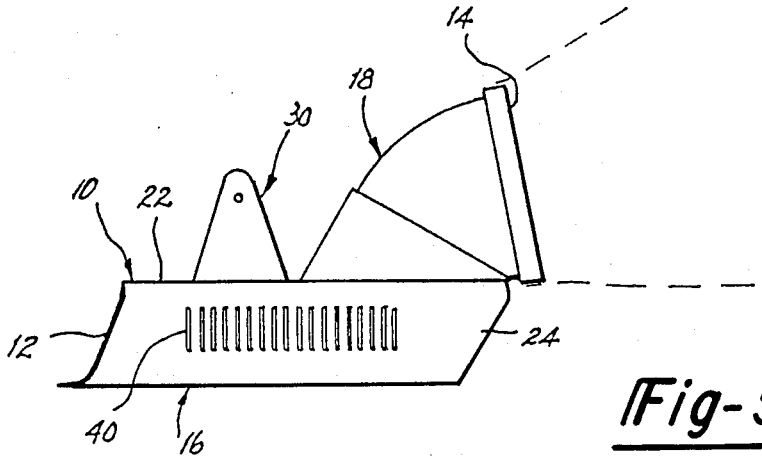
FIG. 5 is a fragmentary side elevational view of a pool cleaner according to the second embodiment.

In the embodiment of FIG. 5, the sidewalls 24 are provided with all apertures 40.

I claim:

1. A pool cleaner comprising: a hollow body having a first inlet end, a second outlet end and an intake portion; the intake portion including a roof, a pair of side walls depending from the roof and providing means at their lower end for engagement with a pool surface for movement therealong, an open front providing said first inlet end, and an open bottom between said means for engagement with the pool surface; coupling means for coupling a handle to the body; and a water-pervious collection receptacle having its inlet end detachably mountable on the body about the outlet end thereof and adapted to close over said outlet end when said pool cleaner is removed from the pool to prevent reentry of debris from said receptacle into the pool.

2. A pool cleaner as claimed in claim 1 wherein the intake portion of the body tapers inwardly from the inlet end.

3. A pool cleaner as claimed in claim 1 wherein the body includes an outlet portion extending upwardly and rearwardly of the intake portion adjacent and terminating in said outlet end, said outlet portion providing a wall at the rear end of the intake portion.

4. A pool cleaner as claimed in claim 3 wherein said outlet portion opens into the intake portion at a portion of the roof thereof.

5. A pool cleaner as claimed in claim 1 wherein small apertures are formed in each side wall of the intake portion.

6. A pool cleaner as claimed in claim 1 wherein the means for engagement with the pool surface comprises a runner provided on the lowermost end of each side wall for supporting said pool cleaner for movement along the pool surface.

7. A pool cleaner as claimed in claim 6 wherein an inturned flange on the lowermost end of each side wall provides the respective runner.

8. A pool cleaner as claimed in claim 1 wherein the collection receptacle comprises a mesh bag.

9. A pool cleaner as claimed in claim 1 wherein the coupling means incorporates a pivotal joint to permit relative movement between the handle and the body.

10. A pool cleaner as claimed in claim 9 wherein the pivotal joint comprises a universal joint.

11. A pool cleaner as claimed in claim 9 wherein a locking means is provided for selectively locking the handle and the body against said relative movement.

* * * * *